US012145239B2

(12) United States Patent
Akbal et al.

(10) Patent No.: US 12,145,239 B2
(45) Date of Patent: Nov. 19, 2024

(54) METHOD FOR ASSISTING A USER IN APPLYING AN ADHESIVE LABEL TO THE SURFACE OF AN OPHTHALMIC LENS WITH AN INITIAL CONTOUR PRIOR TO AN EDGE GRINDING OPERATION, AND DEVICE FOR IMPLEMENTING THE METHOD

(71) Applicant: ESSILOR INTERNATIONAL, Charenton le Pont (FR)

(72) Inventors: Jean-René Akbal, Chareton le Pont (FR); Hugues Ameurlain, Chareton le Pont (FR); Nicolas Jamet, Chareton le Pont (FR); Laurence Scodellaro, Chareton le Pont (FR)

(73) Assignee: Essilor International, Charenton-le-Pont (FR)

( * ) Notice: Subject to any disclaimer, the term of this patent is extended or adjusted under 35 U.S.C. 154(b) by 665 days.

(21) Appl. No.: 17/439,656

(22) PCT Filed: Mar. 10, 2020

(86) PCT No.: PCT/EP2020/056372
§ 371 (c)(1),
(2) Date: Sep. 15, 2021

(87) PCT Pub. No.: WO2020/187651
PCT Pub. Date: Sep. 24, 2020

(65) Prior Publication Data

US 2022/0152771 A1 May 19, 2022

(30) Foreign Application Priority Data

Mar. 15, 2019 (EP) ..... 19305319

(51) Int. Cl.
*B24B 9/14* (2006.01)
*B24B 13/00* (2006.01)
(Continued)

(52) U.S. Cl.
CPC ..... *B24B 9/146* (2013.01); *B24B 13/00* (2013.01); *B24B 13/0055* (2013.01); *B24B 47/225* (2013.01)

(58) Field of Classification Search
CPC ..... B24B 9/14; B24B 9/146; B24B 13/00; B24B 13/0006; B24B 13/0012;
(Continued)

(56) References Cited

U.S. PATENT DOCUMENTS 10,010,994 B2 * 7/2018 Gacoin ..... B24B 13/005
2002/0149862 A1 * 10/2002 Wallendorf ..... B24B 9/146 359/811
(Continued)

FOREIGN PATENT DOCUMENTS

CN 1921983 A 2/2007
CN 101118318 A 2/2008
(Continued)

OTHER PUBLICATIONS

International Search Report for PCT/EP2020/056372 dated May 26, 2020, 5 pages.
(Continued)

*Primary Examiner* — Eileen P Morgan
(74) *Attorney, Agent, or Firm* — NIXON & VANDERHYE

(57) ABSTRACT

Disclosed is a method for assisting a user in taping an adhesive label to a surface of an ophthalmic lens with an initial contour prior to edge grinding, the method including:—holding of the ophthalmic lens with its initial contour by a holder,—determining, from geometric data for the final
(Continued)

contour of the ophthalmic lens to be produced, of a position of the final contour inside the initial contour of the ophthalmic lens,—creating a visual aid for the user enabling the latter to apply the adhesive label to the ophthalmic lens with its initial contour prior to edge grinding, such that the adhesive label can be applied inside the final contour.

20 Claims, 7 Drawing Sheets

(51) Int. Cl.
*B24B 13/005* (2006.01)
*B24B 47/22* (2006.01)

(58) Field of Classification Search
CPC ..... B24B 13/0018; B24B 13/0031; B24B 13/0037; B24B 13/0043; B24B 13/0052; B24B 13/0055; B24B 13/06; B24B 17/026; B24B 47/22; B24B 47/225; B24B 51/00
USPC ..... 451/42, 43, 54, 254, 255, 256
See application file for complete search history.

(56) References Cited

U.S. PATENT DOCUMENTS

| | | | | |
|---|---|---|---|---|
| 2005/0173046 | A1* | 8/2005 | Savoie | B24B 13/005 156/101 |
| 2007/0177101 | A1 | 8/2007 | Divo | |
| 2008/0149269 | A1 | 6/2008 | Suzuki | |
| 2012/0238191 | A1* | 9/2012 | Schneider | B24B 13/0052 451/384 |
| 2014/0340633 | A1 | 11/2014 | Luc et al. | |
| 2015/0077546 | A1 | 3/2015 | Videcoq et al. | |
| 2017/0136597 | A1 | 5/2017 | Molinaro et al. | |

FOREIGN PATENT DOCUMENTS

| | | | | | |
|---|---|---|---|---|---|
| CN | 102985220 | A | * | 3/2013 | B24B 1/00 |
| CN | 104460047 | A | | 3/2015 | |
| CN | 105764652 | A | | 7/2016 | |
| CN | 104159706 | B | * | 11/2016 | B24B 13/005 |
| FR | 2 878 976 | | | 6/2006 | |
| JP | 2016525717 | A | * | 8/2016 | |
| KR | 20040052573 | A | * | 6/2004 | |
| KR | 20070030765 | A | | 3/2007 | |
| KR | 20080058244 | A | | 6/2008 | |
| WO | WO-2006061477 | A1 | * | 6/2006 | B24B 13/005 |
| WO | 2016/012721 | | | 1/2016 | |

OTHER PUBLICATIONS

Written Opinion of the ISA for PCT/EP2020/056372 dated May 26, 2020, 6 pages.
Office Action and Search Report issued in Chinese Patent Application No. 202080014833.7 dated Dec. 23, 2022.
Office Action, issued in Korean Patent Application No. 10-2021-7025286 dated Jul. 22, 2024.
Office Action, issued in Brazilian Patent Application No. BR112021014604-0 dated Jul. 21, 2024.

* cited by examiner

METHOD FOR ASSISTING A USER IN APPLYING AN ADHESIVE LABEL TO THE SURFACE OF AN OPHTHALMIC LENS WITH AN INITIAL CONTOUR PRIOR TO AN EDGE GRINDING OPERATION, AND DEVICE FOR IMPLEMENTING THE METHOD

This application is the U.S. national phase of International Application No. PCT/EP2020/056372 filed Mar. 10, 2020 which designated the U.S. and claims priority to EP patent application Ser. No. 19/305,319.6 filed Mar. 15, 2019, the entire contents of each of which are hereby incorporated by reference.

BACKGROUND OF THE INVENTION

Field of the Invention

The present invention relates to a method for assisting a user in applying an adhesive sticker to a face of an ophthalmic lens with an initial contour prior to an edging operation, and to a device for implementing the method.

Description of the Related Art

The present invention concerns the edging of glasses or lenses, most particularly ophthalmic glasses or lenses.

An ophthalmic lens results from a succession of molding and/or surfacing/polishing operations, which determine the geometry of the two (convex and concave) optical surfaces of said glass, then appropriate surface treatments.

The final step in the finishing of an ophthalmic lens is an edging operation, which consists in machining the edge face or periphery of the lens so as to give it the dimensions required to fit in a spectacle frame into which it is intended to be placed.

The edging, also called trimming, is generally carried out on a grinder comprising diamond grinding wheels which perform the machining as defined above.

To this end, the lens is held, during this operation, by blocking members that act axially with respect to the optical axis of the lens.

The relative movement of the lens with respect to the grinding wheel is controlled, generally digitally, in order to achieve the desired shape in a very precise manner.

It will therefore be appreciated that it is absolutely essential for the lens to be firmly held during this movement. Indeed, any blocking defect can result in a machining defect and in a defect of the final contour, which can have the consequence that the machined lens cannot be mounted in the spectacle frame for which it is intended.

Therefore, prior to the edging operation, the lens is blocked, that is to say a holding means or block is positioned on the convex surface of the lens. This block is affixed to the lens by means of a double-sided adhesive called a pad placed on the surface of the block.

The lens thus equipped is positioned on one of the aforementioned axial blocking members, the second axial blocking member then clamping the lens on its concave face via a stop, which is generally made of elastomer.

During the machining, a tangential torque force is generated on the lens, which can cause the lens to rotate relative to the block if the device holding the glass is not efficient enough. This phenomenon is to be avoided, since the correct axial arrangement of the lens (correct alignment) in the frame is essential for lenses treating astigmatism and/or presbyopia.

To avoid this phenomenon of misalignment on slippery lenses, and in particular on lenses comprising an antifouling surface treatment ("top coat" for a person skilled in the art), which is generally hydrophobic or oleophobic, an adhesive sticker or retainer, for example a simple adhesive, is arranged between the assembly formed by the block and the pad, on the one hand, and the convex surface of the lens, on the other hand. This adhesive sticker is therefore different and is not to be confused with the pad forming an adhesive surface of the block itself. Generally, the holding blocks are pre-equipped with such pads.

However, this adhesive sticker is generally affixed to the convex surface of the lens by hand, and its optimal position must depend on the shape and position of the center of the finished ophthalmic lens, i.e. the lens having the final contour to be mounted in a suitable frame chosen by an end wearer.

However, incorrect positioning of the adhesive sticker can have negative consequences:

- Affixing the adhesive sticker at the wrong place can cause the adhesive sticker to come out of the final shape after cutting and may have the following as a consequence:
- Contact between the adhesive sticker and the edging tools may cause wear or breakage of said tools, in particular when using a milling cutter or a drill.
- Detachment of the adhesive sticker during edging, or non-cutting of the adhesive sticker protruding from the final contour, may lead to water infiltration under the adhesive sticker during edging, which can cause a total loss of adhesion of the sticker.
- If the sticker is also not situated exactly enough at the blocking location of the block, some areas of the pad may be in direct contact with the lens, leading to less robust retention of the lens in the holding members.

However, this operation of affixing the adhesive sticker is difficult for an operator who does not know a priori the final shape of the ophthalmic lens and therefore the position where the block should preferably block the lens prior to the edging operation and hence the position or the orientation in the case of a non-circular sticker.

The present invention provides a simple, efficient and economical solution to this problem.

SUMMARY OF THE INVENTION

To this end, the subject of the invention is a method for assisting a user in applying an adhesive sticker to a face of an ophthalmic lens with an initial contour prior to edging, the method comprising:

- maintaining the ophthalmic lens with its initial contour using a support,
- determining, from geometric data of the final contour to be produced for the ophthalmic lens, a positioning of the final contour inside the initial contour of the ophthalmic lens,
- forming a visual aid for the user, allowing them to apply the adhesive sticker to the ophthalmic lens with its initial contour prior to edging, such that the adhesive sticker can be applied inside the final contour.

By virtue of the invention, the adhesive sticker (or retainer) can be positioned precisely and without any risk of coming into contact with the edging tools when cutting the lens in order to obtain its final shape.

The invention may further comprise one or more of the following aspects taken alone or in combination:

The method may further comprise determining, within said positioning of the final contour, a theoretical position of the block for blocking the ophthalmic lens before edging, and the visual aid corresponds to a zone centered on the theoretical position of the block during the edging operation and adapted to indicate this position.

The visual aid has, for example, a shape making it possible to indicate an orientation and a centering of the adhesive sticker to be applied, in particular in the case where the adhesive sticker has a non-circular contour.

The visual aid has in particular a shape corresponding to the contour of the adhesive sticker that is to be affixed.

In the specific case where the adhesive sticker has, for example, a non-circular elliptical contour, the visual aid indicates the orientation of the adhesive sticker to be affixed corresponding to the orientation of the block during the edging operation.

According to one exemplary embodiment, the step of forming a visual aid may comprise forming a visual aid image. It is therefore an immaterial, non-intrusive and contactless visual aid, which does not risk damaging the ophthalmic lens.

The method comprises, for example, capturing with a camera, in real time, images of the ophthalmic lens with its initial contour, maintained by the support, and the real-time display of these images on a viewing screen by superimposing the visual aid on these captured images or by embedding the visual aid in these captured images.

A display of the final contour of the ophthalmic lens superimposed on said images can also be achieved.

According to another embodiment, forming a visual aid image comprises projecting an image of a visual aid onto the ophthalmic lens, in particular with a laser or an image projector.

The invention also relates to a method for edging an ophthalmic lens, comprising

- providing an ophthalmic lens,
- providing a block,
- providing an adhesive sticker,
- forming a visual aid to assist a user in applying an adhesive sticker to a face of an ophthalmic lens with an initial contour according to a method as described above, further comprising
- roller-pressing the adhesive sticker onto the ophthalmic lens with its initial contour before edging substantially centered and oriented according to the visual aid,
- fixing the block on the adhesive sticker, and also
- edging the ophthalmic lens, held by means of said block, in a trimming machine.

The invention also relates to a device for implementing a method as described above, comprising

- a support for maintaining the ophthalmic lens with its initial contour,
- a processing unit configured to determine, from geometric data of the final contour to be produced for the ophthalmic lens, a positioning of the final contour inside the initial contour of the ophthalmic lens,
- a unit for forming a visual aid controlled by the processing unit and configured to allow a user to apply the adhesive sticker to the ophthalmic lens with an initial contour before edging, such that the adhesive sticker can be applied inside the final contour.

The processing unit is for example configured to determine, within the positioning of the final contour, the theoretical position of a block for blocking the ophthalmic lens during the edging operation, and the unit for forming the visual aid is configured to form a visual aid centered on the position of a block and adapted to indicate this position.

The visual aid may have a shape corresponding to a contour of the adhesive sticker.

The unit for forming the visual aid has, for example, a shape configured to make it possible to indicate an orientation and a centering of the adhesive sticker to be applied, in the case where the adhesive sticker has a non-circular contour.

The device comprises, for example, a camera configured to take real-time images of the ophthalmic lens with its initial contour maintained by the support, and the unit for forming the visual aid comprises a viewing screen configured for real-time display of the images by superimposing the visual aid on them or by embedding the visual aid in these captured images.

The unit for forming the visual aid is in particular configured to display the zone corresponding to the position of the final contour of the ophthalmic lens superimposed on said images.

BRIEF DESCRIPTION OF THE DRAWINGS

Other features and advantages of the invention will emerge from the following description, given by way of example and without a limiting nature, with reference to the appended drawings in which.

DESCRIPTION OF THE PREFERRED EMBODIMENTS

In all the figures, the elements having identical functions bear the same reference numbers.

The following embodiments are examples. Although the description refers to one or more embodiments, this does not necessarily mean that each reference relates to the same embodiment, or that the features apply only to one embodiment. Simple features of different embodiments can also be combined or interchanged to provide other embodiments.

Figure 1:
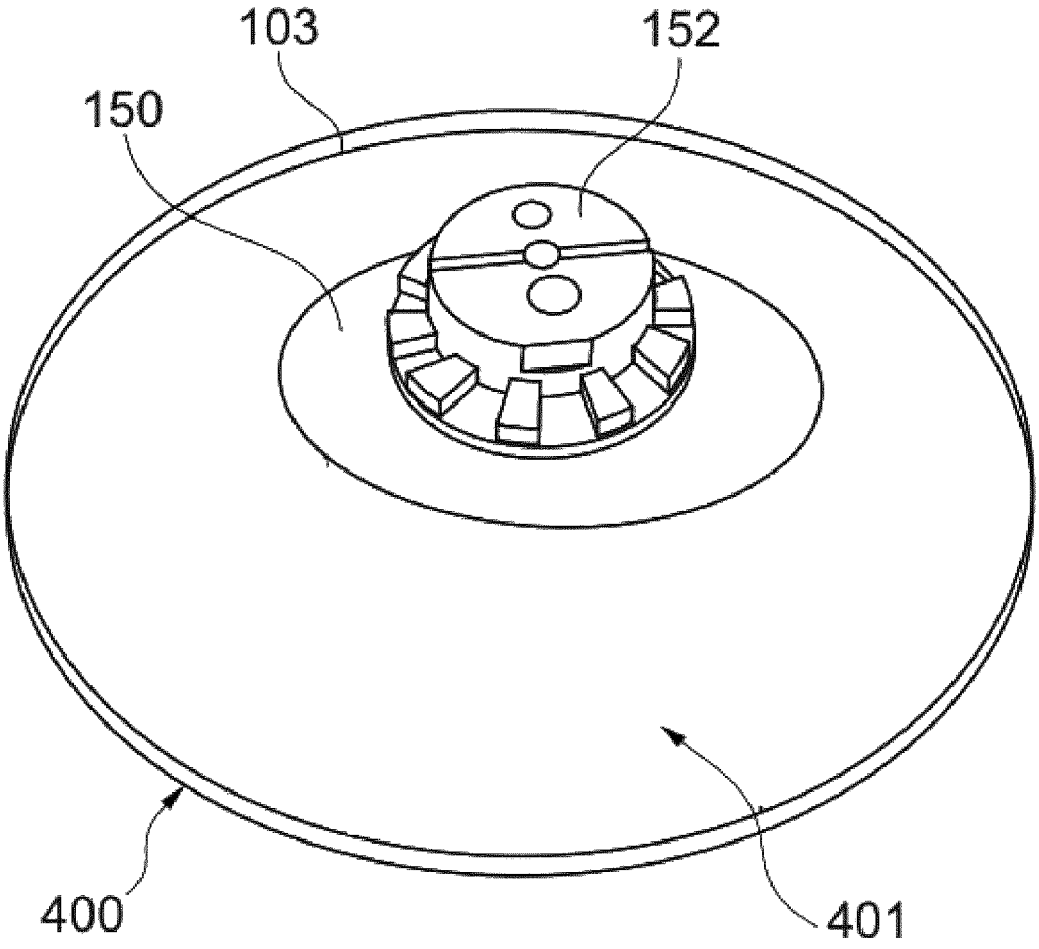
FIG. 1 is an example of an ophthalmic lens on which an adhesive sticker has been deposited using a block.

FIG. 1 shows the result of the assembly intended to be carried out in particular by an operator before an edging operation using the method and the device according to the invention. FIG. 1 shows an ophthalmic lens 103 with its initial contour 400. An adhesive sticker 150 and also a block 152 have been affixed to this ophthalmic lens, on the convex surface 401 thereof.

Figure 2:
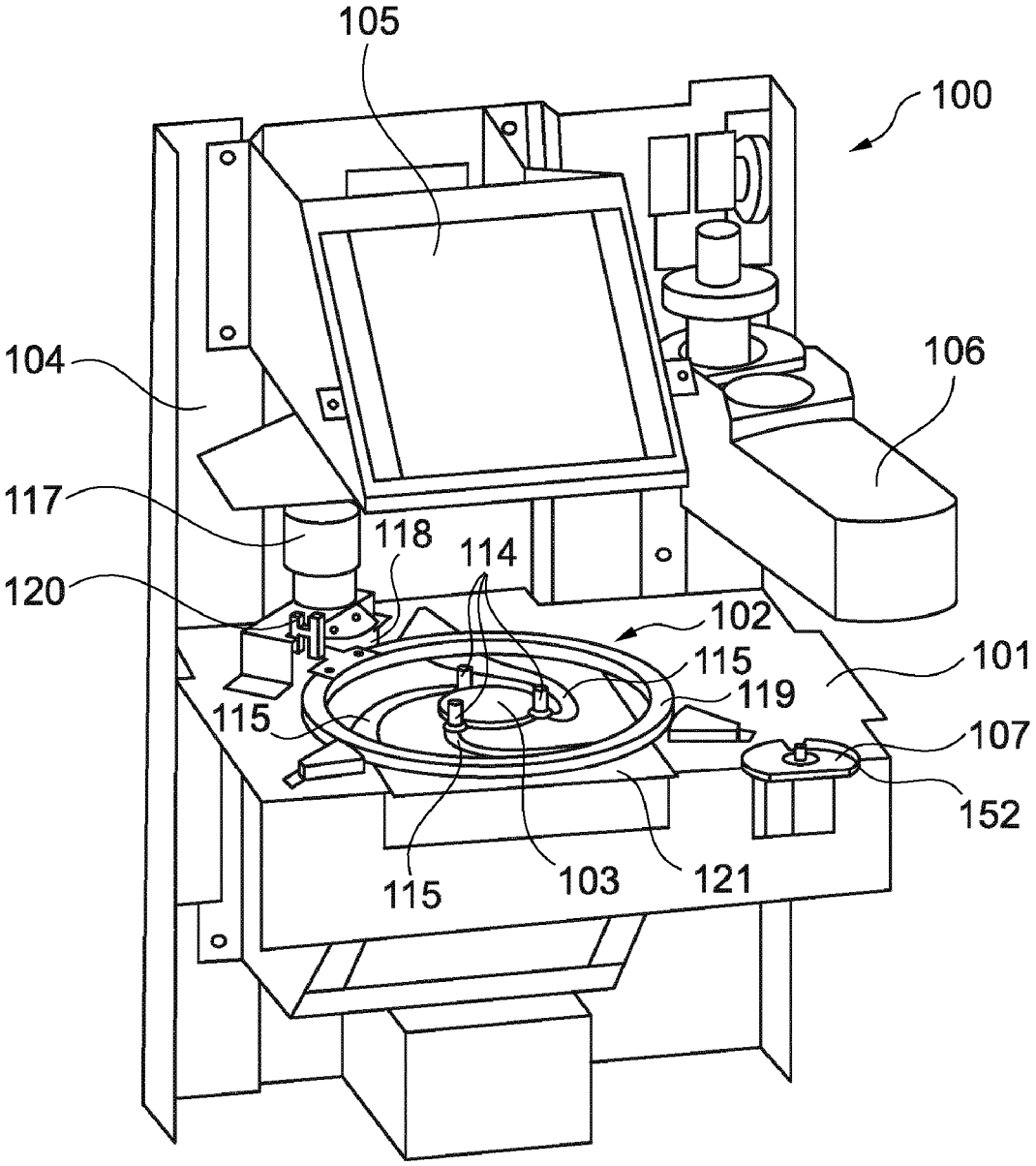
FIG. 2 is a general perspective view of an embodiment of a centering/blocking device for the implementation of a method according to the invention.

To this end, FIG. 2 shows schematically an embodiment of a centering/blocking device 100 according to the invention making it possible to assist a user in applying an adhesive sticker 150 to a face of an ophthalmic lens 103 prior to the edging operation.

It may be specified that the adhesive sticker 150 is for example double-sided and self-adhesive, for example an adhesive of the Rikipad Z-6018 type distributed by VIGte-Qnos©.

This centering/blocking device 100 comprises in particular a work console 101 on which is placed a centering mechanism 102 for centering an ophthalmic lens 103. It may be a unifocal, bifocal or trifocal lens or else an ophthalmic lens with progressive addition of power, also commonly called a progressive lens.

In the present application, the terms "glass" or ophthalmic lens denote an organic or inorganic glass substrate, treated or not, depending on whether it comprises one or more coatings of various kinds or whether it remains bare.

In the present case, it is an ophthalmic lens before trimming or edging, with a circular initial contour 400, for example with a diameter of 80 mm. The ophthalmic lens 103 may have undergone one or more surface treatments.

The ophthalmic lenses more particularly concerned by the present invention are glasses which have a hydrophobic and/or oleophobic surface coating and preferably glasses comprising both a hydrophobic and/or oleophobic surface coating deposited on a monolayer or multilayer anti-reflective coating, preferably on the two optical faces of said ophthalmic lens.

In fact, the hydrophobic and/or oleophobic coatings are generally applied to glasses comprising an anti-reflective coating, in particular of mineral material, in order to reduce their marked tendency to soiling, for example with regard to fatty deposits.

As indicated above, the hydrophobic and/or oleophobic coatings are obtained by applying, to the surface of the anti-reflective coating, compounds that reduce the surface energy of the glass, which generally implies that the direct application of a block to the ophthalmic lens for the edging does not provide sufficient support.

The function of the adhesive sticker 150 is in particular to increase the surface energy perceived by the block temporarily during the edging, thus allowing effective retention during an edging or trimming operation. In particular, the adhesive sticker 150, having a contact surface with the ophthalmic lens 103 much larger than the block 152, for its part has a sliding adhesion with the surface of the lens 103 greater than that possible for the block 152, and in particular increased adherence during application of a tangential force, such as that applied during the edging. Furthermore, the adhesive sticker 150 generally has a lower tear-off adhesion than that of the pad of the block 152, in order to be able to be removed from the surface of the ophthalmic lens 103 following the edging.

The centering/blocking device 100 further comprises a viewing screen 105 fixed to the frame 104 in such a way as to be oriented in order to be visible to the user working at the work console 101.

The centering mechanism 102 of the work console 101 comprises here, for example, a set of three jaws 114 with concentric clamping, each carried by an arm 115 pivoting about an axis (not visible in FIG. 2) fixed with respect to the work console 101. The arms are arranged such that their joint rotation around their respective axis allows the three jaws 114 to come together.

The clamping of the jaws 114 is controlled by a motor 117 of which the axle is integral with a pinion 118 meshing with a ring 119 adapted to drive the arms 115 in rotation about their axis.

The arms 115 in fact each comprise a semi-circular toothed portion (not shown) meshing with the outer periphery of the crown 119.

The rotation of the pinion 118, under the action of the motor 117, thus drives the crown 119 in rotation in order to cause the clamping or unclamping of the jaws 114, depending on the direction in which the crown 119 is driven. An incremental encoder, for example a rotary encoder, allows the motor 117 to know the position of the crown 119.

The assembly formed by the arms 115 carrying the jaws 114, and by the crown 119, is arranged above a support plate 121 adapted to allow light to pass through.

Furthermore, as is shown in FIG. 2, the centering/blocking device 100 comprises a positioning arm 106, preferably automated, connected to the frame 104 and adapted to collect, with the aid of a pincer for example, a block 152 disposed on a receptacle 107, and to deposit the block 152 at a location determined by calculation on the front face of said ophthalmic lens 103, and in particular on the front face covered with the aforementioned adhesive sticker 150.

With this in mind, the centering/blocking device 100 is configured to detect the position of a centering and/or axis marker of the ophthalmic lens 103.

Figure 3:
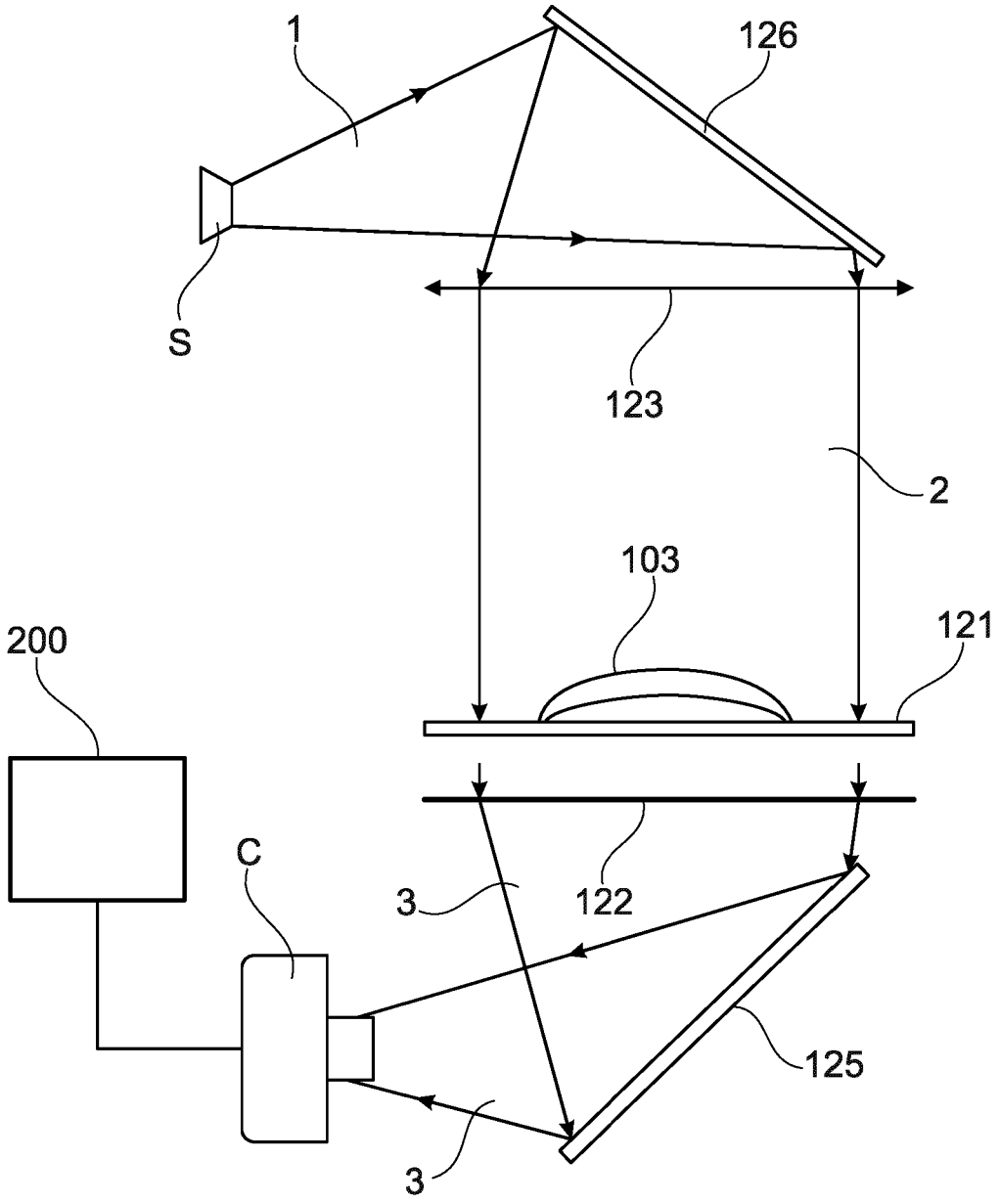
FIG. 3 is a simplified optical diagram of the device of FIG. 2.

For this, as is shown schematically in FIG. 3, the centering/blocking device 101 advantageously comprises:

- a support for the ophthalmic lens 103,
- on either side of said support, on the one hand, means for illuminating the ophthalmic lens 103 installed on said receiving means and, on the other hand,
- means for acquiring and analyzing the light transmitted by said ophthalmic lens 103.

The support is formed here, for example, by a support plate 121 transparent to light and/or by the centering mechanism 102.

According to the example shown, the illumination means comprise in particular a light source S which emits a diverging light beam 1 in the direction of a return system comprising a mirror 126 inclined at 45° and a converging lens 123 adapted to form a luminous flux 2 with parallel rays in the direction of the ophthalmic lens 103 deposited on the support plate 121 with its front face, provided with the centering and/or axis marker(s), facing toward said converging lens 123.

The acquisition and analysis means here comprise a digital camera C, image processing means 200 configured to process the signal obtained at the output of digital camera C, and means for displaying the processed signal, consisting in particular of the viewing screen 105. Said acquisition and analysis means comprise, between the support plate 121 and the digital camera C, an optical system for returning the light beam transmitted by and around the ophthalmic lens 103, comprising in particular a frosted plate 122 forming a screen and a mirror 125 inclined at 45°. The digital camera C collects, via the optical angular return effected by the inclined mirror 125, the images or shadows projected on the frosted screen 122.

Advantageously, in the centering/blocking device 100, said support for the ophthalmic lens, said illumination means and said acquisition and analysis means are fixed with respect to one another.

In addition, as is shown in FIG. 3, it comprises a single optical path between said illumination means and said acquisition and analysis means, which has the advantage of reducing the size and manufacturing costs of the device, and above all of obtaining a lasting measurement precision.

The centering/blocking device 100 described above permits the implementation of a method for assisting a user in applying an adhesive sticker 150 to a face of an ophthalmic lens 103 with its initial contour 400, in particular a circular contour, prior to edging.

Figure 4:
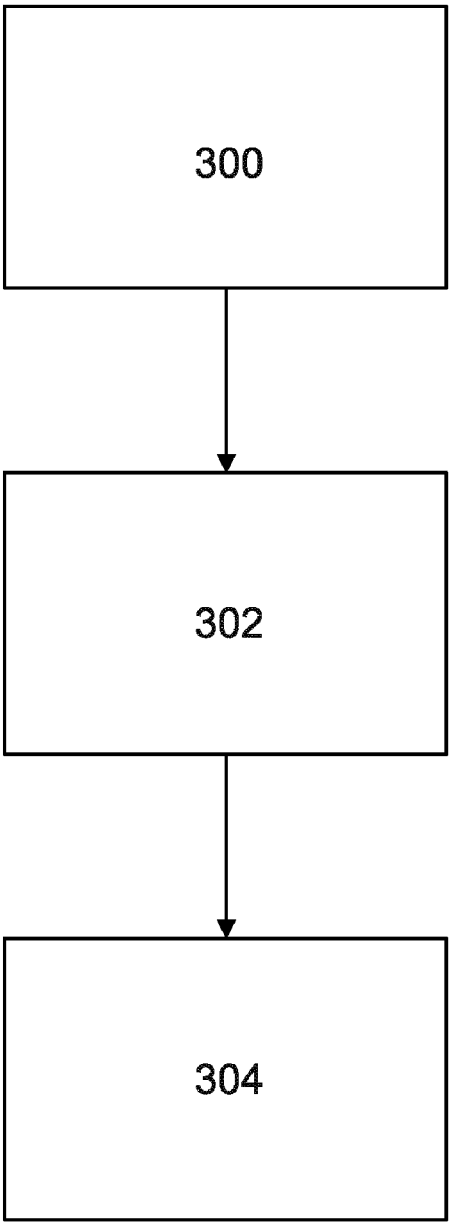
FIG. 4 is a block diagram of an example of the method according to the invention.

This method comprises the following steps (see FIG. 4):

During a step 300, the ophthalmic lens 103 is fixed with its initial circular contour 400 in a support formed more particularly by the centering mechanism 102 or the support plate 121. This operation can be followed in real time by the user on the viewing screen 105 of the work console 101. Indeed, the ophthalmic lens 103 is illuminated by parallel rays of light 2, and the initial contour 400 of the ophthalmic lens 103 is visible on the frosted screen 122 and is imaged by the camera C. The image(s) acquired is/are transmitted to the viewing screen 105 by the image processing means 200. More specifically, the image processing means 200 can detect the initial contour of the ophthalmic lens 103 and replace, for example in the images transmitted to the viewing screen 105, all the pixels outside the detected initial contour by pixels of a predefined color, for example black.

Furthermore, when fixing the ophthalmic lens 103 on the centering mechanism 102 or placing it on the support plate 121, the user has, for example via an input interface (not shown), informed the processing means 200 of geometric data and characteristics of the ophthalmic lens 103, in particular the shape of the final contour 402 (visible in FIGS. 5 and 6) to be produced inside the initial contour 400 and the position and orientation with respect to the latter.

During a step 302, a projection or positioning of the final contour 402 inside the initial contour 400 of the ophthalmic lens 103 is determined from geometric data of the final contour 402 to be produced for the ophthalmic lens 103. The geometric data of the final contour 402, or frame data, are obtained either from a database or, directly or indirectly, from the measurement of a contour of a rim of the spectacle frame or from the measurement of a contour of a presentation spectacle lens initially mounted in said frame. Furthermore, the determination of the projection or of the positioning of the final contour 402 inside the initial contour 400 of the ophthalmic lens 103 is obtained either from a database or from a file, having been determined in a previous step, or by calculation, by means of a processor, taking into account said frame data, wearing data and centering data of the ophthalmic lens. The wearing data here express quantities measured in the wearing condition, either real or virtual, of the frame by the wearer or end user. The wearing data are for example linked to the position of the wearer's pupil relative to the position of the contour of the ophthalmic lens in the wearing condition. These are, for example, the so-called height data, pupillary distance (PD) data, boxing data. The glass centering data here express the data corresponding to the position of the wearer's pupil with respect to the geometry of the optical surfaces of the spectacle lens. These centering data are generally associated with an optical center of the ophthalmic lens, or a fitting mark, a near-vision zone, a far-vision zone, etc. These assembly data can come from a database or a file or can be extracted by means of the centering machine, by identifying, automatically or manually, either micro circles or ink markings on the ophthalmic lens 103 to be edged, such as a mounting cross or an optical center marker, etc.

Then, during a step 304, a visual aid is created for the user, allowing him to apply the adhesive sticker 150 to the ophthalmic lens 103 with its initial contour 400 prior to edging, such that the adhesive sticker 150 can be applied inside the final contour 402 and at the exact position of the blocking. The images are thus displayed for example on the viewing screen 105 by superimposing on or embedding in these images, taken by the camera C, the final contour 402 of the ophthalmic lens 103 as a visual aid. The step of forming a visual aid therefore comprises forming a visual aid image which can be displayed on the screen or, according to another embodiment, can be projected as an image by an image projector or a laser onto the ophthalmic lens 103.

Figure 5:
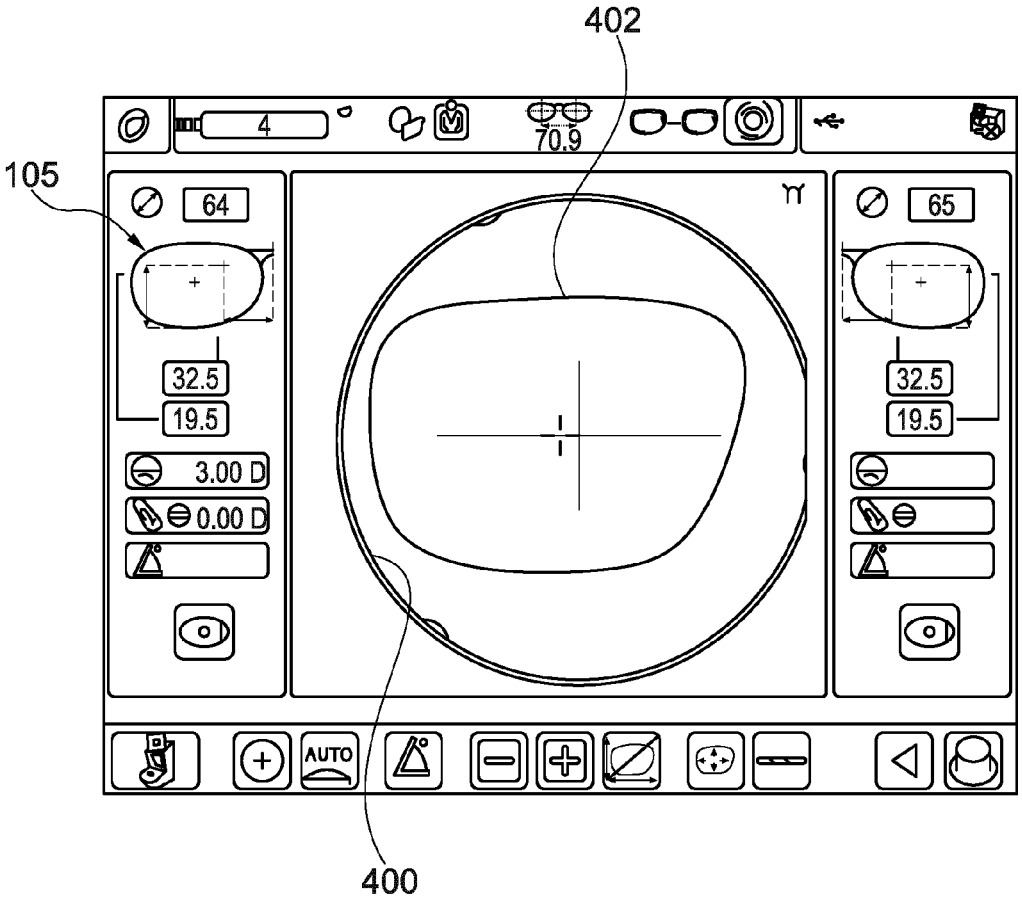
FIG. 5 is an example of a first screen displayed by the centering/blocking device.
Figure 6:
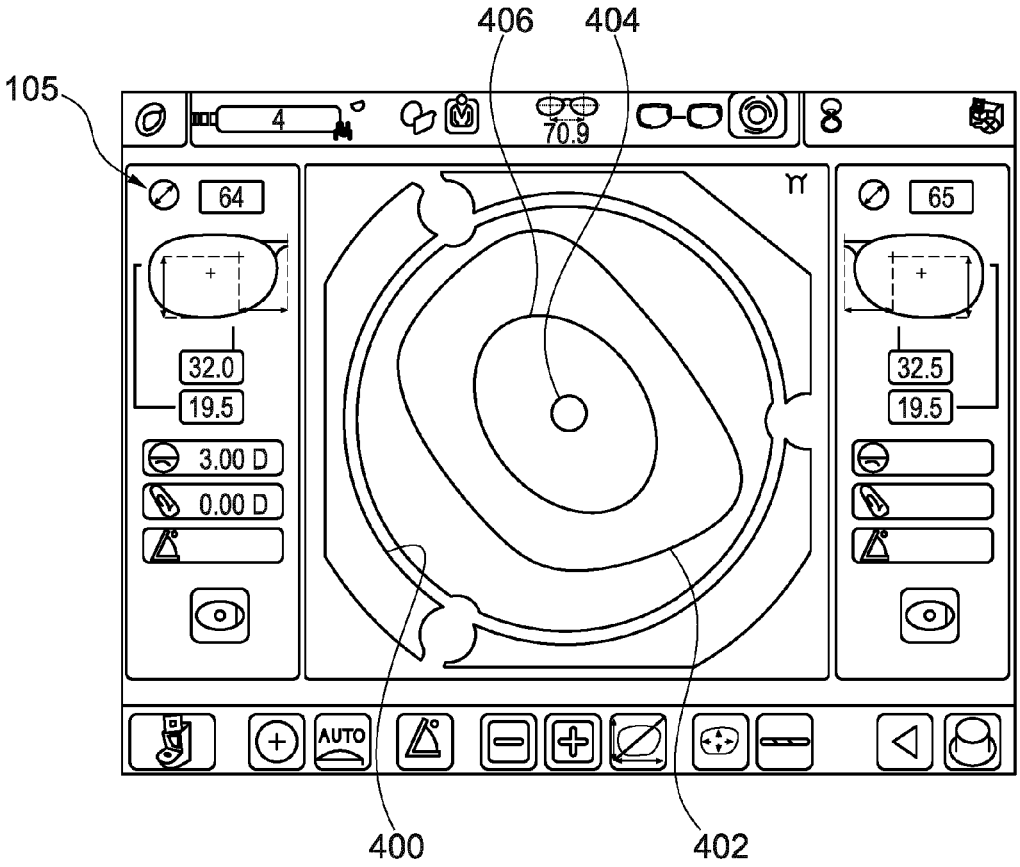
FIG. 6 is an example of a second screen displayed by the centering/blocking device.

FIG. 5 shows an example of a display of a viewing screen 105 prior to the step of using the visual aid of the invention. In this FIG. 5, the processing means 200 have displayed a photo taken by the camera C and replaced the pixels outside the initial contour 400 with black pixels. Inside the initial contour 400, the processing means 200 have projected a final contour 402 of the ophthalmic lens 103 that is to be produced. The user is thus able to verify, for example, that the positioning of the final contour of the ophthalmic lens, of the centering point corresponding to a point of the ophthalmic lens intended to face the wearer's pupil in the wearing condition of the ophthalmic lens, which have been determined by the machine, match the image of the ophthalmic lens and in particular any mounting marks visible on the ophthalmic lens. Furthermore, it is possible to verify that the positioning of the final contour of the ophthalmic lens is indeed included in the initial contour of the ophthalmic lens. Here, the centering point corresponds to the white cross visible in the photo.

According to one embodiment of the invention, the operator, or an optician manipulating the centering/blocking according to the invention, can activate the visual aid function by selecting a corresponding button on the viewing screen. Alternatively, the visual aid function can be systematic or pre-programmed. The viewing screen then changes to that of FIG. 6. This screen then continuously displays images taken by the camera, in real time, without necessarily having the processing means 200 artificially removing the support means of the ophthalmic lens. The processing means 200 determine, inside the projection or the positioning of the final contour 402, the theoretical position of a block 152 which will be used to block the ophthalmic lens 103 prior to edging and determines the position of a visual aid indicating to the user a zone corresponding to the desired position for affixing the sticker.

In some cases, the adhesive sticker 150 has a non-circular elliptical contour with a central hole, and the processing means 200 show on the viewing screen a visual aid in the form of a contour of the sticker 406 and of the central hole 404 embedded in the image which indicates, inside the final contour 402, the orientation of the adhesive sticker 150 that is to be affixed. Thus, while looking at the viewing screen 105, the user is able to affix the adhesive sticker 150 in a precise manner by roller-pressing. In this case, it will be appreciated that the visual aid is "as it were" immaterial and produced by embedding visual information (here the image of the contour 406 of the sticker and/or of the final contour 402) which are displayed on the screen at the same time as the capture of the ophthalmic lens 103 by the camera C. This embedding can be done by replacing certain displayed pixels with a determined color, for example red or black.

According to an alternative not shown, the visual aid comprises a device for erasable or temporary marking on the ophthalmic lens 103 with its initial contour 400, which indicates the final contour 402 and/or a zone 404 corresponding to the position of the block 152 during the edging operation and/or a sticker contour 406. It is therefore a temporary physical marking by affixing of material.

In general, the visual aid comprises indicators for centering of the adhesive sticker 150 and indicators for orientation of said adhesive sticker 150. Thus, in the example above, the elliptical contour is both an indicator of the orientation of the adhesive sticker 150 and also an indicator making it possible to optimally position the center of the adhesive sticker. This second aspect is reinforced by the presence of a representation 404 of the hole present at the middle of the adhesive sticker 150.

Figure 7:
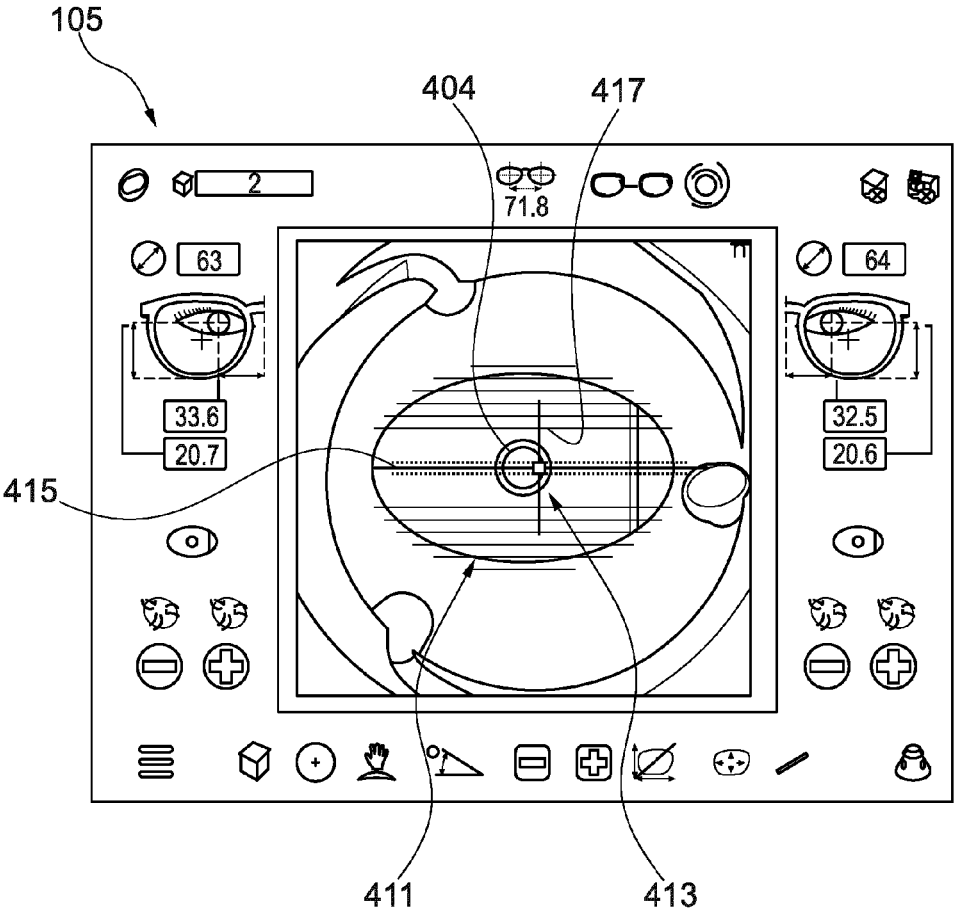
FIG. 7 is an example of a third screen displayed by the centering/blocking device.

However, instead of forming a visual aid of similar or identical contour to the sticker used, it is possible to form any other visual aid allowing centering and orientation of the visual aid. As examples of alternatives, the visual aid may include a series of markers making it possible firstly to correctly orient the adhesive sticker 150 according to its main axis or long axis (by the major axis of the ellipse if the sticker is elliptical), then another series of markers making it possible in a second step to position the center of the sticker at the desired position. For example, this may be the formation of one or more lines 411 parallel to an axis which is long and of various sizes, making it possible to deduce a center 413 as shown by way of example in FIG. 7.

This may be the formation of lines 415 along a long axis and of lines 417 along a short axis, the two said axes intersecting, said lines 415 and 417 possibly comprising end-of-line indicators such as arrows or dots. Alternatively, there may be only a mark of the sticker center instead of the one corresponding to the hole contour 404, for example by means of a circle and one or more marks indicating a long axis direction with respect to the center, for example lines (see also FIG. 7). Alternatively, it may be a total or partial combination of several of the above examples or even other alternative means.

According to certain alternatives, the final contour 402 of the ophthalmic lens is displayed during the formation of the visual aid, for example by display on a viewing screen. According to other alternatives, the visual aid is formed or displayed alone, without the presence of the final contour of the ophthalmic lens.

It will thus be appreciated that the present invention makes it possible ultimately to affix, for example by an operator and by roller-pressing and in a precise manner, an adhesive sticker 150 to an ophthalmic lens 103 prior to edging, so as to permit effective retention during the trimming operations.

After said roller-pressing, the block can be fixed to the adhesive sticker present on the ophthalmic lens, and the latter can be easily trimmed or edged.

The invention claimed is:

1. A method for assisting a user in applying an adhesive sticker by roller-pressing to a face of an ophthalmic lens with an initial contour prior to edging, the method comprising:

maintaining the ophthalmic lens with the ophthalmic lens' initial contour using a support, determining, from geometric data of the final contour to be produced for the ophthalmic lens, a positioning of the final contour inside the initial contour of the ophthalmic lens, forming a visual aid for the user, allowing them to apply the adhesive sticker by roller-pressing to the ophthalmic lens with its initial contour prior to edging, such that the adhesive sticker can be applied by roller-pressing inside the final contour.

2. The method as claimed in claim 1, further comprising determining, within said positioning of the final contour, a theoretical position of the block for blocking the ophthalmic lens prior to edging, and the visual aid corresponding to a zone centered on the theoretical position of the block during the edging operation and adapted to indicate this position.

3. The method as claimed in claim 1, wherein the visual aid has a shape making it possible to indicate an orientation and a centering of the adhesive sticker that is to be applied.

4. The method as claimed in claim 3, wherein the visual aid has a shape corresponding to the contour of the adhesive sticker that is to be affixed.

5. The method as claimed in claim 1, wherein the adhesive sticker has a non-circular elliptical contour, in which the visual aid indicates the orientation of the adhesive sticker to be affixed corresponding to the orientation of the block during the edging operation.

6. The method as claimed in claim 1, wherein the step of forming a visual aid comprises forming a visual aid image.

7. The method as claimed in claim 1, further comprising capturing with a camera, in real time, images of the ophthalmic lens with its initial contour, maintained by the support, and the real-time display of these images on a viewing screen by superimposing the visual aid on these captured images or by embedding the visual aid in these captured images.

8. The method as claimed in claim 7, further comprising displaying the final contour of the ophthalmic lens superimposed on said images.

9. The method as claimed in claim 6, wherein forming a visual aid image comprises projecting an image of a visual aid onto the ophthalmic lens.

10. A method for edging an ophthalmic lens, comprising providing an ophthalmic lens, providing a block, providing an adhesive sticker, forming a visual aid in order to assist a user in applying an adhesive sticker to a face of an ophthalmic lens with an initial contour according to claim 1, further comprising roller-pressing the adhesive sticker onto the ophthalmic lens with the ophthalmic lens' initial contour prior to edging, substantially centered and oriented according to the visual aid, fixing the block on the adhesive sticker, and also edging the ophthalmic lens, maintained by means of said block, in a trimming machine.

11. A device for implementing a method as claimed in claim 1, comprising a support for maintaining the ophthalmic lens with the ophthalmic lens' initial contour, a processing unit configured to determine, from geometric data of the final contour to be produced for the ophthalmic lens, a positioning of the final contour inside the initial contour of the ophthalmic lens, a unit for forming a visual aid controlled by the processing unit and configured to allow a user to apply the adhesive sticker by roller-pressing to the ophthalmic lens with an initial contour prior to edging, such that the adhesive sticker can be applied inside the final contour.

12. The device as claimed in claim 11, wherein the processing unit is configured to determine, within the positioning of the final contour, the theoretical position of a block for blocking the ophthalmic lens during the edging operation, and the unit for forming the visual aid is configured to form a visual aid centered on the position of a block and adapted to indicate this position.

13. The device as claimed in claim 11, wherein the visual aid has a shape corresponding to a contour of the adhesive sticker.

14. The device as claimed in claim 11, wherein the unit for forming the visual aid has a shape configured to permit indication of an orientation and a centering of the adhesive sticker that is to be applied by roller-pressing.

15. The device as claimed in claim 11, further comprising a camera configured to take real-time images of the ophthalmic lens with the ophthalmic lens' initial contour maintained by the support, and the unit for forming the visual aid comprises a viewing screen configured for real-time display of the images by superimposing the visual aid on them or by embedding of the visual aid therein.

16. The device as claimed in claim 11, wherein the unit for forming the visual aid is configured to display the zone corresponding to the position of the final contour of the ophthalmic lens superimposed on said images or embedded in them.

17. The method as claimed in claim 2, wherein the visual aid has a shape making it possible to indicate an orientation and a centering of the adhesive sticker that is to be applied.

18. The method as claimed in claim 2, wherein the adhesive sticker has a non-circular elliptical contour, in which the visual aid indicates the orientation of the adhesive sticker to be affixed corresponding to the orientation of the block during the edging operation.

19. The method as claimed in claim 3, wherein the adhesive sticker has a non-circular elliptical contour, in which the visual aid indicates the orientation of the adhesive sticker to be affixed corresponding to the orientation of the block during the edging operation.

20. The method as claimed in claim 4, wherein the adhesive sticker has a non-circular elliptical contour, in which the visual aid indicates the orientation of the adhesive sticker to be affixed corresponding to the orientation of the block during the edging operation.

* * * * *